US005168132A

United States Patent [19]

Beidl et al.

[11] Patent Number: 5,168,132

[45] Date of Patent: Dec. 1, 1992

[54] EXHAUST GAS MUFFLER

[76] Inventors: Christian Beidl, Edelsbach 51, A-8063 Eggersdorf; Albin Sterbenz, Friedmanngasse 20, A-8041 Graz, both of Austria

[21] Appl. No.: 693,383

[22] Filed: Apr. 30, 1991

[30] Foreign Application Priority Data

Apr. 30, 1990 [AT] Austria ..... 985/90

[51] Int. Cl.[5] ..... F01N 1/08

[52] U.S. Cl. ..... 181/265; 181/266; 181/276; 181/282

[58] Field of Search ..... 181/265, 266, 268, 269, 181/270, 272, 273, 276, 281, 282

[56] References Cited

U.S. PATENT DOCUMENTS

| | | | |
|---|---|---|---|
| 2,113,828 | 4/1938 | Compo | 181/272 |
| 2,922,485 | 1/1960 | Muller | 181/265 |
| 3,289,786 | 12/1966 | Powers | 181/265 |

*Primary Examiner*—Michael L. Gellner
*Assistant Examiner*—Khanh Dang
*Attorney, Agent, or Firm*—Collard & Roe

[57] ABSTRACT

An exhaust gas muffler comprises a double-walled casing having an inlet end receiving a stream of the exhaust gas and an outlet end for the exhaust gas, the outlet end comprising an outer tube surrounding a perforated inner tube spaced therefrom, and the tubes defining therebetween a perforation resonator chamber succeeded by a whistling sound resonator. The casing includes an outer wall and a corrugated inner wall defining a gap with the outer wall. A heat-resistant and sound-damping intermediate layer is arranged in the gap between the inner and outer walls and braces the inner wall against the outer wall. Transverse partitions divide the casing into a plurality of chambers between the inlet and outlet ends, and tubes connect the chambers and reverse the exhaust gas stream at least twice between the inlet and outlet ends.

4 Claims, 1 Drawing Sheet

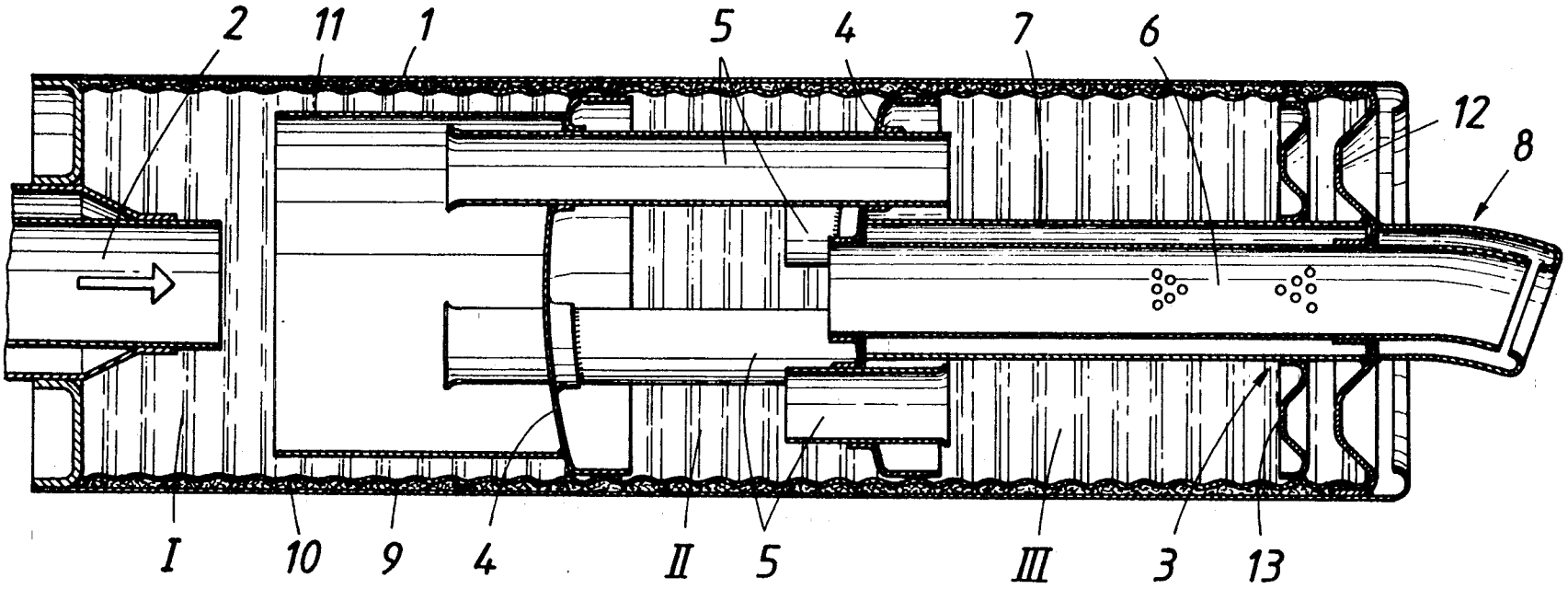
8
12
6
7
4
5
1
11
2
13
3
III
5
II
4
9
10
I

EXHAUST GAS MUFFLER

BACKGROUND OF THE INVENTION

1. Field of the Invention

The present invention relates to an exhaust gas muffler particularly useful for two-stroke engines with succeeding catalyst and comprising a double-walled casing having an inlet end receiving a stream of the exhaust gas and an outlet end for the exhaust gas, the outlet end comprising an outer tube surrounding a perforated inner tube spaced therefrom, and the casing including an outer wall and an inner wall defining a gap with the outer wall. A heat-resistant intermediate layer is arranged in the gap between the inner and outer walls, transverse partitions divide the casing into a plurality of chambers between the inlet and outlet ends, and tubes connect the chambers and reverse the exhaust gas stream at least twice between the inlet and outlet ends.

2. Description of the Prior Art

An exhaust gas muffler of this type has been disclosed in U.S. Pat. No. 3,289,786. The outlet communicates directly with the ambient atmosphere and the perforation resonator chamber between the inner and outer outlet tubes is incapable of balancing all unfavorable sound frequencies. The inner wall of the casing is smooth so that heat stresses may occur. As disclosed in col. 14 of the patent (see also U.S. Pat. No. 2,761,525 mentioned there), an intermediate heat-resistant layer of asbestos sheet may be disposed in the double-wall of the casing to reduce the formation of condensation by increasing the temperature inside the muffler casing. This cannot improve the surface sound reflection.

SUMMARY OF THE INVENTION

It is accordingly a primary object of this invention to obviate these disadvantages and to provide an exhaust gas muffler of the first-described type with improved sound muffling properties and a reduced surface temperature.

The above and other objects are accomplished according to the invention with such a muffler whose outlet tubes define therebetween a perforation resonator chamber succeeded by a whistling sound resonator, whose casing inner wall is corrugated and whose intermediate heat-resistant layer is sound-damping and braces the inner wall against the outer wall of the casing.

The two successive resonator chambers at the outlet end balance the unfavorable sound frequencies which have been poorly damped in conventional mufflers. The corrugated inner wall of the casing, which is braced by the sound-absorbing intermediate layer, prevents a sound radiation from the casing surface, the corrugation of the inner wall improving the sound absorption and the bracing of the inner wall held under tension by the intermediate layer effectively reducing the radiation of sound from the surface. At the same time, this heat-resistant intermediate layer also prevents excessively high surface temperatures of the casing when a catalyst precedes the muffler. This intermediate layer may preferably be comprised of ceramic fibers bonded by a swelling bonding medium, the swelling of the bonding medium causing the corrugated inner wall to be braced against the outer wall of the casing.

According to a preferred feature of the present invention and for further protection of the casing wall when the muffler is used with a preceding catalyst, the muffler further comprises a cylindrical heat-protective shield mounted in a first one of the casing chambers at the inlet end and shielding the double-wall of the casing. The heat-protective shield is preferably affixed to a first one of the transverse partitions dividing the first casing chamber from a succeeding one of the casing chambers.

According to another preferred feature of this invention and to prevent the flash gases coming from the catalyst to impact the transversely extending head affixed to the doublewall of the casing at the outlet end while, at the same time, contributing to the sound absorption, a transversely extending protective wall is mounted ahead of the head to protect the head against impact of the exhaust gas stream, the transversely extending head and protective wall defining a buffer chamber therebetween. While U. S. Pat. No. 3,289,786 discloses a wall ahead of the outlet head, it cannot function as a protective wall since the perforated outlet tube passes through the gap between this wall and the outlet head whereby pressure waves and hot exhaust gases directly enter this gap.

BRIEF DESCRIPTION OF THE DRAWING

The above and other objects, advantages and features of the invention will become more apparent from the following description of a now preferred embodiment thereof, taken in conjunction with the accompanying single figure showing the exhaust gas muffler in an axial cross section.

DETAILED DESCRIPTION OF PREFERRED EMBODIMENT

Referring now to the drawing, there is shown an exhaust gas muffler comprising substantially cylindrical double-walled casing 1 having inlet end 2 receiving a stream of the exhaust gas and outlet end 3 for the exhaust gas. The muffler forms a structural unit which may be connected to an exhaust pipe of an exhaust gas system. Because of the high operating temperatures encountered and the strong vibrations, the use of absorbing materials is difficult.

As shown in the drawing, the outlet end comprises outer tube 7 surrounding perforated or louvered inner tube 6 spaced therefrom, and tubes 6, 7 define therebetween a perforation resonator chamber succeeded by whistling sound resonator 8 defined between the outer ends of the outlet tubes beyond transversely extending head 12 of the muffler. Casing 1 includes an outer wall and corrugated inner wall 9 defining a gap with the outer wall. Heat-resistant and sound-damping intermediate layer 10 is arranged in the gap between the inner and outer walls and braces the inner wall against the outer wall. Layer 10 may be composed of ceramic fibers bonded by a swelling bonding agent whose swelling will hold inner casing wall 9 under tension.

Transverse partitions constituted by domed metal sheets 4 divide casing I into a plurality of chambers I, II and III between inlet and outlet ends 2, 3, and tubes 5 pass through sheet metal partitions 4 to connect chambers I, II, III to enable the stream of exhaust gas to pass successively through these chambers from the inlet to the outlet end. Tubes 5 are so arranged that the exhaust gas flow is reversed at least twice between the inlet and outlet ends, being reversed in chambers III and II in the illustrated embodiment.

Cylindrical heat-protective shield 11 is mounted in first casing chamber I at inlet end 2 and shields the double-wall of casing I. The heat-protective shield is affixed to first transverse partition 4 dividing first casing chamber I, into which the inlet pipe projects, from succeeding casing chamber II.

Since the exhaust gases flow directly into casing chamber III at outlet end 3 through at least one of connecting tubes 5 and would thus impact directly on transversely extending outlet head 12 affixed to the double-wall of the casing, transversely extending protective wall 13 is mounted ahead of head 12 to protect the head against impact of the exhaust gas stream, transversely extending head 12 and protective wall 13 defining a buffer chamber therebetween.

What is claimed is:

1. An exhaust gas muffler comprising (a) a double-walled casing having (1) an inlet end receiving a stream of the exhaust gas and (2) an outlet end for the exhaust gas, the outlet end comprising an outer tube surrounding an inner tube spaced therefrom, the outer and inner tubes defining therebetween a perforation resonator chamber succeeded by a whistling sound resonator, a portion of the inner tube along the perforation resonator chamber being perforated and a narrow annular gap being defined between the outer and inner tubes at an outlet end of the whistling sound resonator, and a transversely extending head separating the perforation resonator chamber from the whistling sound resonator, and the casing including (3) an outer wall and (4) a corrugated inner wall defining a gap with the outer wall, (b) a heat-resistant and sound-damping intermediate layer arranged in the gap between the inner and outer walls and bracing the inner wall against the outer wall, (c) transverse partitions dividing the casing into a plurality of casing chambers between the inlet and outlet ends, and (d) tubes connecting the chambers and reversing the exhaust gas stream at least twice between the inlet and outlet ends.

2. The exhaust gas muffler of claim 1, further comprising a cylindrical heat-protective shield mounted in a first one of (the casing chambers) at the inlet end and and concentric with, and shielding, the double-wall of the casing.

3. The exhaust gas muffler of claim 2, wherein the heatprotective shield is affixed to a first one of the transverse partitions dividing the first casing chamber from a succeeding one of the casing chambers.

4. The exhaust gas muffler of claim 1, wherein the transversely extending head is affixed to the double-wall of the casing at the outlet end and extends into an outermost of the casing chambers between the outer tube and the double-wall, and further comprising a transversely extending protective wall mounted in the outermost casing chamber ahead of the head to project the head against impact of the exhaust gas stream, the transversely extending head and protective wall defining a buffer chamber therebetween.

* * * * *